United States Patent [19]

Jarrett

[11] 4,343,112

[45] Aug. 10, 1982

[54] APPARATUS FOR GRINDING METALLOGRAPHIC SPECIMENS

[76] Inventor: Tracy C. Jarrett, P.O. Box 15397, Denver, Colo. 80215

[21] Appl. No.: 176,510

[22] Filed: Aug. 8, 1980

[51] Int. Cl.[3] ..... B24B 7/04

[52] U.S. Cl. ..... 51/131.3; 51/166 T

[58] Field of Search ..... 51/166 T, 131.3, 131.4, 51/120, 109

[56] References Cited

U.S. PATENT DOCUMENTS

| | | | |
|---|---|---|---|
| 1,479,205 | 1/1924 | Parker | 51/131.3 |
| 2,423,367 | 7/1947 | Bolender | 51/166 T |
| 2,658,313 | 11/1953 | Bowen | 51/131.3 |
| 3,708,921 | 1/1973 | Cronkhite | 51/131.4 |

*Primary Examiner*—Harold D. Whitehead
*Attorney, Agent, or Firm*—Ralph F. Crandell

[57] ABSTRACT

A grinding machine for grinding and polishing metallographic specimens. A multiple-grinder, indexable, vertical grinder assembly is supported on a rigid frame enclosed within a housing. A rotating, vertically positionable specimen holder assembly is also supported on the frame within the said housing, for holding specimens in grinding position. A coolant and grinding fluid system supported on the frame supplies coolant and grinding fluid to specimens supported in said specimen holder during the grinding thereof. The specimen holder is vertically positionable relative to the grinder assembly, so that specimens held by the holder can be ground and polished by a selected successive plurality of grinders.

8 Claims, 14 Drawing Figures

APPARATUS FOR GRINDING METALLOGRAPHIC SPECIMENS

BACKGROUND OF THE INVENTION

1. Field of the Invention

The present invention relates to grinding or abrading apparatus of the type including rotary grinding laps and a rotating work holder. More specifically, the invention relates to a grinding apparatus for grinding metallurgical specimens.

2. Description of the Prior Art

Metallographers have traditionally devoted great attention, time and expense to the preparation of metallographic specimens or samples for microscopic examination. The metallographic requirements have invariably been costly in terms of supplies consumed and labor invested in specimen grinding. A single specimen may require nearly an entire day of hand grinding, consuming a quantity of grinding papers of various grits. Larger laboratories and industrial operations with need for specimens in quantity have been seeking a better way to prepare samples for years.

Clarity in specimens does not mean a highly reflective, polished face. Good viewing under a microscope requires that a specimen clearly show every variation and flaw in the surface, every inclusion and minor structural variation. It requires that grinding marks be eliminated without smearing and final polishing be kept to a minimum.

OBJECTS AND SUMMARY OF THE INVENTION

It is the principal object of the present invention to provide an improved apparatus for automatically grinding metallurgical specimens.

Another object of the present invention is to provide a grinding apparatus capable of improving specimen flatness and clarity with uniform and repeatable results.

A further object of the present invention is to provide a grinding apparatus which eliminates hand labor for the entire grinding process.

Still another object of the present invention is to provide a grinding apparatus which eliminates wasteful grinding papers, reduces the time required to complete a properly ground specimen and provides the correct grinding steps and the correct time duration for each step, in order to precisely meet the requirements for grinding specimens of a variety of metals, minerals and synthetic materials.

Still a further object of the invention is to provide an automatic grinding apparatus which minimizes grinding marks while producing flat specimens in a minimum time and with minimum grinding lap wear.

Other objects and advantages of the present invention will become apparent from the following description and drawings illustrating the preferred embodiment of the present invention.

In accordance with the foregoing objects, the present invention is embodied in an automatic grinding apparatus incorporating a rigid frame and exterior housing. A multiple station, indexable, vertical grinder assembly is supported on the frame and includes a plurality of vertical spindle grinders each having a depending grinding head with a downwardly facing lap plate. Each grinding head is driven at a preselected speed and the assembly is indexable to position a selected head over a specimen holding rotary chuck. The grinder assembly includes a rigid plate supporting the grinder heads which are mounted on a central spindle housing the main drive shaft. The spindle and plate assembly is indexable, being driven by an indexing motor, chain and sprocket assmebly, together with an indexing pin for accurate alignment of the selected grinding head with respect to the chuck. The main spindle is driven by a power source including a prime mover mounted on the rigid frame. Pulley and belt assemblies connected to the grinding heads provide the desired speed ratios.

The indexing pin is latched into engagement with the spindle housing and removed therefrom for indexing by an index pin motor such as a piston and cylinder arrangement. The grinding head assembly is supported on the main mounting plate secured to the rigid frame which in turn supports the spindle housing. The mounting plate is thick and rigid enough to provide a stable, vibration free, mounting for the grinding assembly.

The specimen chuck is likewise mounted on the mounting plate. The chuck is engaged with a rotary shaft or spindle supported in a spindle housing which is in turn supported on the main mounting plate. The chuck spindle is driven by a prime mover mounted on the frame and coupled to the spindle by a chain and sprocket assembly.

To provide for cooling and lubrication during the grinding operation, a coolant system includes a coolant tank, pump and appropriate filters. Coolant is sprayed onto the specimen chuck and juxtaposed grinding head through nozzles, and the coolant is collected in a pan supported on the mounting plate and surrounding the grinding assembly and specimen chuck assembly. Seals or traps are provided where rotary members pass through the pan to prevent the loss of coolant.

The specimen chuck is adapted to hold a plurality of specimens which are aligned in the chuck by a mounting apparatus to insure that the specimen faces are coplanar and are at the proper height with respect to the chuck face.

Access openings are provided in the housing or cabinet. Further access to the specimen chuck is provided by an access opening in the grinding assembly supporting plate.

During grinding operations, the specimen chuck is raised and lowered into contact with a grinding head and lap. For this purpose, a yoke-cam type lifting arrangement is provided which includes a piston and cylinder motor coupled to the yoke through a bell crank. The yoke includes rollers engaged in an exterior radial channel on the chuck spindle housing. An important advantage of the lifting assembly resides in the ability to separate the chuck and grinding head and laps in order to provide axial movement between the same to prevent gouging of the specimens as the grinding heads are indexed.

Appropriate controls provide a variety of grinding cycles. Variables include the grit of the laps, the rotational speed of the laps and chuck, the pressure applied between the chuck and laps and the grinding time and sequence. For this purpose, appropriate timing and relay circuits are utilized, all of which may be embodied and controlled in a microcomputer type programmable control system.

DESCRIPTION OF THE PREFERRED EMBODIMENT

Figure 1:
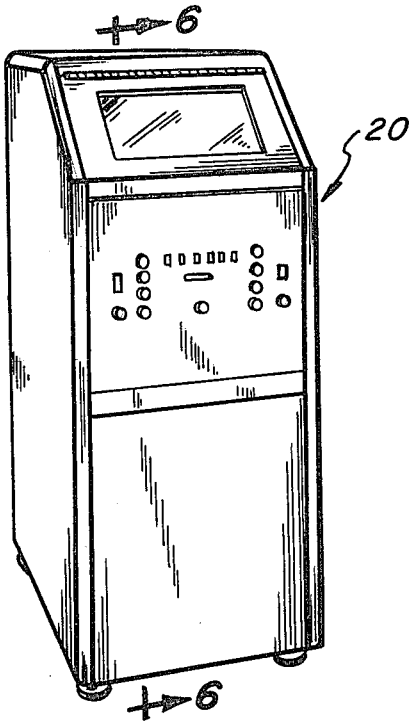
FIG. 1 is an isometric view of a grinding machine and enclosing cabinet embodying the present invention.

The present invention is embodied in the freestanding grinding or abrading apparatus 20 incorporating a rigid frame 21 supporting a heavy main mounting plate 22 and enclosed within a cabinet or housing 24. An access opening 25 in a sloping front surface 26 of the cabinet 24 is closed by a hinged cover 28 provided with a viewing window 29.

Supported within the housing is a specimen chuck assembly 30 for holding a plurality of specimens 32 to be ground and polished, and a multi-station grinder assembly 31 for grinding the specimens 32 supported by the specimen assembly. During the grinding operation, coolant or lubricant is sprayed on the specimens and for this purpose, a circulating coolant system 34 is provided. The various assemblies are driven by appropriate mtors and power units. For controlling the operation of the apparatus, appropriate control units are likewise provided. The grinding assembly, chuck assembly, coolant system, power units, and control units are all mounted on the rigid frame 21 and contained within the housing 24. The various assemblies and units are mounted so as to provide a relatively vibration free structure in order that the grinding may be carried out to extremely fine tolerances.

The grinding assembly 31 incorporates a plurality of vertical grinding heads 40 supported in a generally circular array on a grinding head mounting plate 41. The mounting plate 41 is in turn supported on a spindle housing 42, rotatably mounted on the main frame plate 22.

In addition to supporting the grinding head mounting plate 41, the spindle housing supports a vertical central drive shaft 44 for transmitting power from a main drive or motor 45 to the grinding heads 40. For this purpose, a main drive sheave 46 is secured to the lower end of the shaft 44 and is coupled by a belt 48 to the drive pulley 49 on the motor 45. At the upper end of the spindle housing 42 the shaft 44 is provided with a pair of drive sheaves 50, 51, coupled by means of belts 52, 53 to drive pulleys 54 on each grinding head 40. Tension is maintained in the drive belts 52, 53 by idler wheel assemblies 56, 57.

Each grinding head 40 embodies a vertically oriented sleeve shaft or spindle 60 supported in a spindle housing 61 by roller bearings 62. At its upper end, the spindle or shaft 60 engages the drive pulley 54. At its lower end, the spindle 60 supports a grinding head 64, carrying a lap plate 65 on its lower surface, which in turn supports a lap 66 of the desired surface characteristics for grinding the specimens 32. The grinding head or plate 64 is engaged with the spindle 60 by a clamping bolt 68 which extends axially through the spindle. A clamping bolt 68 is provided at its lower end with a head 69 which engages the grinding plate and lap plate and secures the same tightly to the spindle. At its upper end, the bolt is provided with a nut or other clamping device 70. For supporting the spindle housing of the grinding head 40 on the grinding head mounting plate 41, the spindle housing 61 is provided with a radial mounting flange 71 adapted to be supported on and secured to the plate by cap or machine screws 72, a suitable access opening 74 being provided through the grinding head plate for receiving the spindle housing 61.

In order to provide a multiple grinding operation, a plurality of grinding heads 40 of similar construction are mounted in a circular array on the mounting plate 41. Each grinding head is supplied with a lap 66 of the desired characteristics to provide selected predetermined grinding function. Thus, the laps may vary from coarse, to fine, to very fine, depending upon the surface characteristics desired on the ground specimens. Illustratively, diamond-electroplates and bonded bronze laps find particular utility for use in connection with this apparatus.

For indexing the grinding heads to a selected grinding position, the main spindle housing 42 is rotatably mounted on the main support plate 22. For this purpose, a support spindle sleeve or housing 80 having a flange 81 is mounted on the plate 22 and rotatably supports the main spindle housing 42. The spindle housing 42 is rotatable and indexable relative to the main mounting plate. For this purpose, the housing 42 is provided with a drive sprocket 82 coupled to an index drive motor 84 by a chain 85 which engages the sprocket 82 and a drive sprocket 86 on the gear reduction unit 88 of the index drive motor 84.

In order to precisely position the spindle housing 42 with a grinding head 40 aligned above the specimen chuck assembly 30, the spindle housing 42 is provided with a depending skirt 90 having a plurality of index slots or apertures 91, engageable by an index pin 92 on an index positioning mechanism 94. The index mechanism includes a frame 95 supporting a piston and cylinder unit 96, a piston 97 of which mounts the index pin 92. When the index pin has been retracted by the piston and cylinder unit 96, the spindle housing 42 can be rotated by the action of the drive unit 84 through the chain and sprocket assembly. When a grinding head has been placed in the desired position, the index pin unit 96 is actuated and the index pin is inserted in an appropriate aperture 91. The head end of the index pin 92 is tapered to form a conical camming surface 98, which accurately engages in the index slot to position the spindle housing 42 and thereby the selected grinding head 40 precisely above the specimen chuck assembly.

For supporting the grinding head mounting plate 41, the spindle housing 42 is provided intermediate its ends with a radial flange 100 on which the mounting plate 41 is supported. The mounting plate 41 is formed with a central aperture 101 through which the spindle housing 42 extends when the mounting plate is supported on the flange 100.

The specimen chuck assembly 30 supports and tightly retains the specimens in position for grinding engagement with the lap 66 on a selected grinding head 40. To this end, the specimen chuck assembly 30 is formed by a specimen chuck or head 110 in which the specimens 32 are tightly secured. The specimen chuck 110 is mounted on the upper end of a drive spindle or sleeve 111 which in turn is supported on and driven by a spindle or shaft 112, rotatably mounted in bearings 114 in a housing 115 supported on the main support plate 22. At its lower end, the shaft 112 is operatively coupled to a drive sprocket 116 adapted to be engaged by a chain 118 drivingly engaged with a drive sprocket 119 on the gear box 120 of a chuck drive motor or power unit 121 mounted on the main frame 21.

In order to provide for vertical movement and separation between the grinding laps 66 and the specimens 32 when the positions of the grinding head spindles 40 are being changed which respect to the specimen chuck assembly, to provide further for gradual contact between the specimens and the laps by relative vertical movement therebetween, and to provide for controlled pressure contact between the laps and the specimens, the present invention further contemplates a vertically adjustable chuck assembly. To this end, the vertical chuck assembly drive sleeve or spindle 111 can be moved axially vertically to position the specimens relative to the laps, and the lifting force can be varied to provide for a selectively variable pressure or force between the specimens and the laps. The drive sleeve 111 is adjustably mounted on the upper end of the drive shaft 112 and is drivingly engaged therewith by a pin 122 extending through the drive shaft and engageable in splines or slots 124 in the interior surface of the lower depending end of the drive sleeve 111. In this manner, the drive sleeve 111 can be directly rotatably driven by the shaft 112 at a controlled speed and is axially movable with respect thereto. The abutting surfaces of the shaft 112 and sleeve 111 are lubricated by a lubricant port 125 and zerk fitting 126. At its lower end, the sleeve is provided with an out-turned flange 128 on which is supported a thrust bearing 129, engageable with an inturned shoulder 130 on a cap 131, forming a part of the upper portion of the bearing or sleeve housing 115.

To raise or lower the drive sleeve 111, the sleeve is provided intermediate its ends with out-turned spaced flanges 132, defining therebetween a cam groove or channel 133. The channel 133 receives cam rollers 134 on the ends of a bifurcated yoke 135, forming a part of a lifting mechanism 136. The rollers are secured to the ends of the yoke 135 by stub bolts 137.

The lifting mechanism 136 comprises an air operated variable force piston and cylinder assembly 138 mounted on a frame 139 which in turn is supported on the main frame 21 of the apparatus. The piston 140 of the piston and cylinder assembly 138 carries a forwardly projecting arm 141 pivotally secured to a bell crank 142 which in turn is fixed to the yoke 135. As the piston 140 moves outwardly from the piston and cylinder unit 138, the yoke is lifted to raise the drive sleeve 111 and thereby the chuck 110 and specimens carried thereby, into grinding contact with an abutting lap 66. A proportioning valve 143 serves to control the pressure in the cylinder and thereby the force exerted between the specimen holder and the laps, in accordance with a predetermined selected valve, as controlled by the main control circuit.

The chuck assembly 30 is supported on the main frame plate 22 by a radial flange 145 integral with and extending radially outwardly from the bearing sleeve housing 115. The mounting flange 145 is secured to the plate by appropriate bolts or cap screws 146. The sleeve bearing housing 115 extends through an access opening 148 in the plate 22.

The specimen chuck 110 is supported on the upper end of the drive sleeve 111 and is drivingly engaged therewith by a drive pin 149. For rigidly and accurately supporting the specimens to be ground in precise alignment with the laps, the chuck 110 comprises a massive head 150 supporting a central chuck jaw 151 mounted on the upper face 154 thereof by a mounting bolt 155. Depending upon the number of specimens, the jaw 151 is provided with recesses 156 shaped to receive the specimens 32. A plurality of clamping jaws 158 are provided together with clamping bolts 159 in their peripheral surfaces engageable with the inner clamping jaw 151. The clamping jaws 158 are likewise provided with specimens receiving recesses 160 cooperating with the corresponding recesses 156 in the clamping jaw 151 to tightly hold the specimens in place when the clamping jaws 158 are tightly bolted to the central jaw 151.

The specimens are of conventional shape and configuration, comprising generally a plastic cylinder block 161 in which is embedded a specimen 162 to be examined with the specimen exposed at one circular planar face of the plastic block 161.

During grinding operations, a coolant and lubricant is desirably supplied to the surfaces of the laps 66 and specimens 32 being ground. To this end the coolant system 34 is provided as indicated above and includes a tank 170 containing the appropriate liquid coolant. From the tank, the coolant is circulated by a coolant pump 171 driven off of the main drive shaft 44 by a sheave 172 secured to the shaft and a belt 174 coupled to a pulley 175 on the pump shaft 176. From the pump the coolant is circulated through a conduit 178 to coolant filters 179, 180. From the filters, the coolant flows through a further conduit (not shown) to a spray nozzle manifold 184 on which are mounted one or more spray nozzles 185 directed at the interface between the grinding head lap 66 and the specimens 32 mounted in the specimen chuck 110.

For purposes of collecting the coolant after it has been sprayed on the lap and specimens, there is provided a coolant pan 186 mounted on a frame 187 supported on the plate 22 in surrounding relationship with the specimen chuck assembly 30 and the grinding head assembly 31. To provide for rotating relationship between the specimen chuck assembly 30 and the pan 186, the pan includes an access opening 188 through which the specimen chuck assembly extends, defined by an upwardly extending flange 189 on the pan surrounding the opening 188. The specimen chuck assembly 30 is provided with a depending annular ring flange seal 190 which cooperates with the upstanding flange 189 to form a trap. Similarly, the pan defines an access opening 191 for the grinder assembly formed by an upstanding flange 192. The grinder assembly is in turn provided with an annular depending flange seal 194 in surrounding relationship with the upstanding pan flange 192 to provide a liquid retaining seal.

To prevent the spray from splashing into the balance of the mechanism, the mounting plate 41 is provided with a sliding seal against the pan structure 186. The plate 41 is provided with an access opening 196 for access to the specimen chuck assembly to permit insertion and removal of the chuck 110. This access opening is closed by an access cover 198 when the mechanism is in operating condition.

Figure 2:
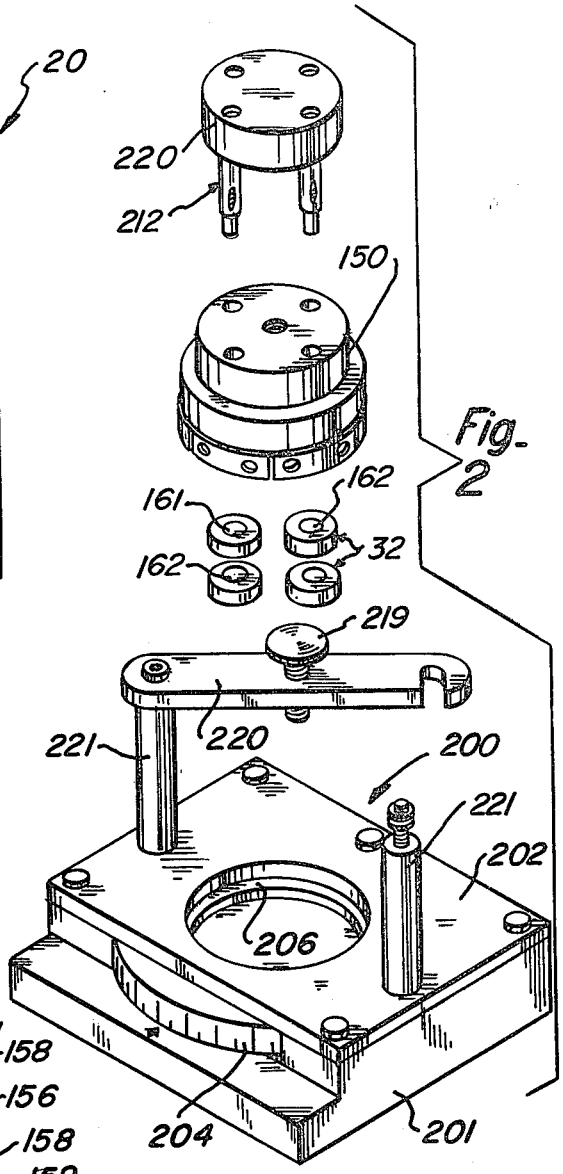
FIG. 2 is an exploded isometric view of a chuck, specimens, and specimen mounting fixture, embodying the present invention.
Figure 4:
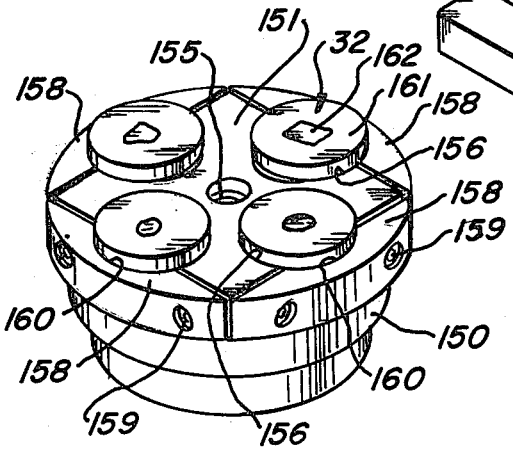
FIG. 4 is an isometric view of a chuck utilized in the grinding machine shown in FIG. 1 with four specimen blocks clamped therein.
Figure 3:
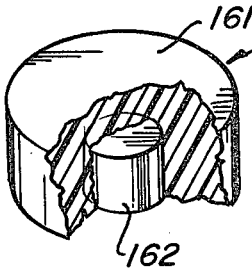
FIG. 3 is an isometric view, with a portion cut away for clarity, of a metallurgical specimen encased in a plastic cylinder block.
Figure 5:
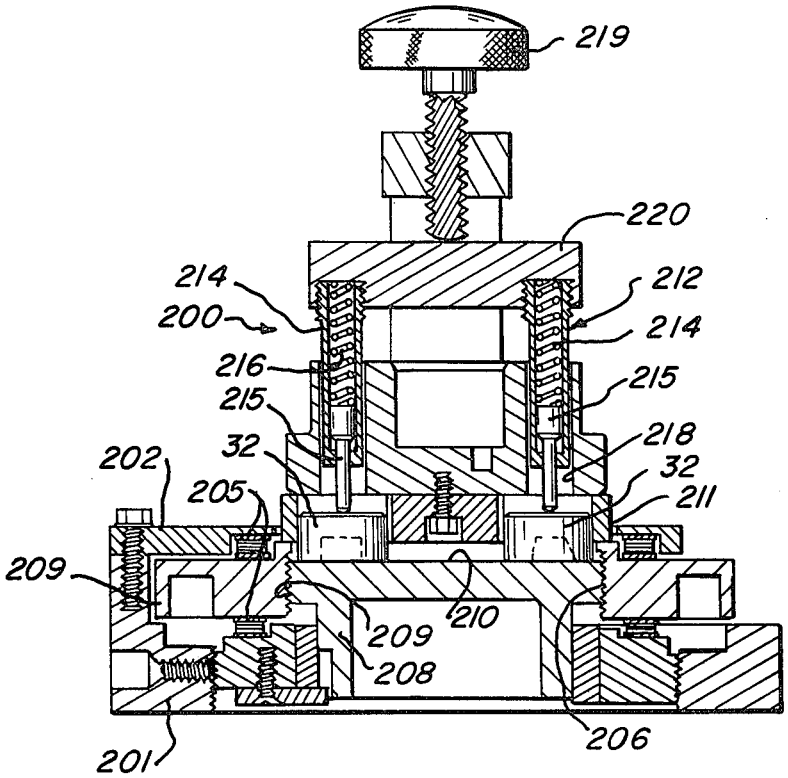
FIG. 5 is a vertical section view through the specimen mounting apparatus shown in FIG. 2, with a specimen chuck and specimens mounted therein.
Figure 6:
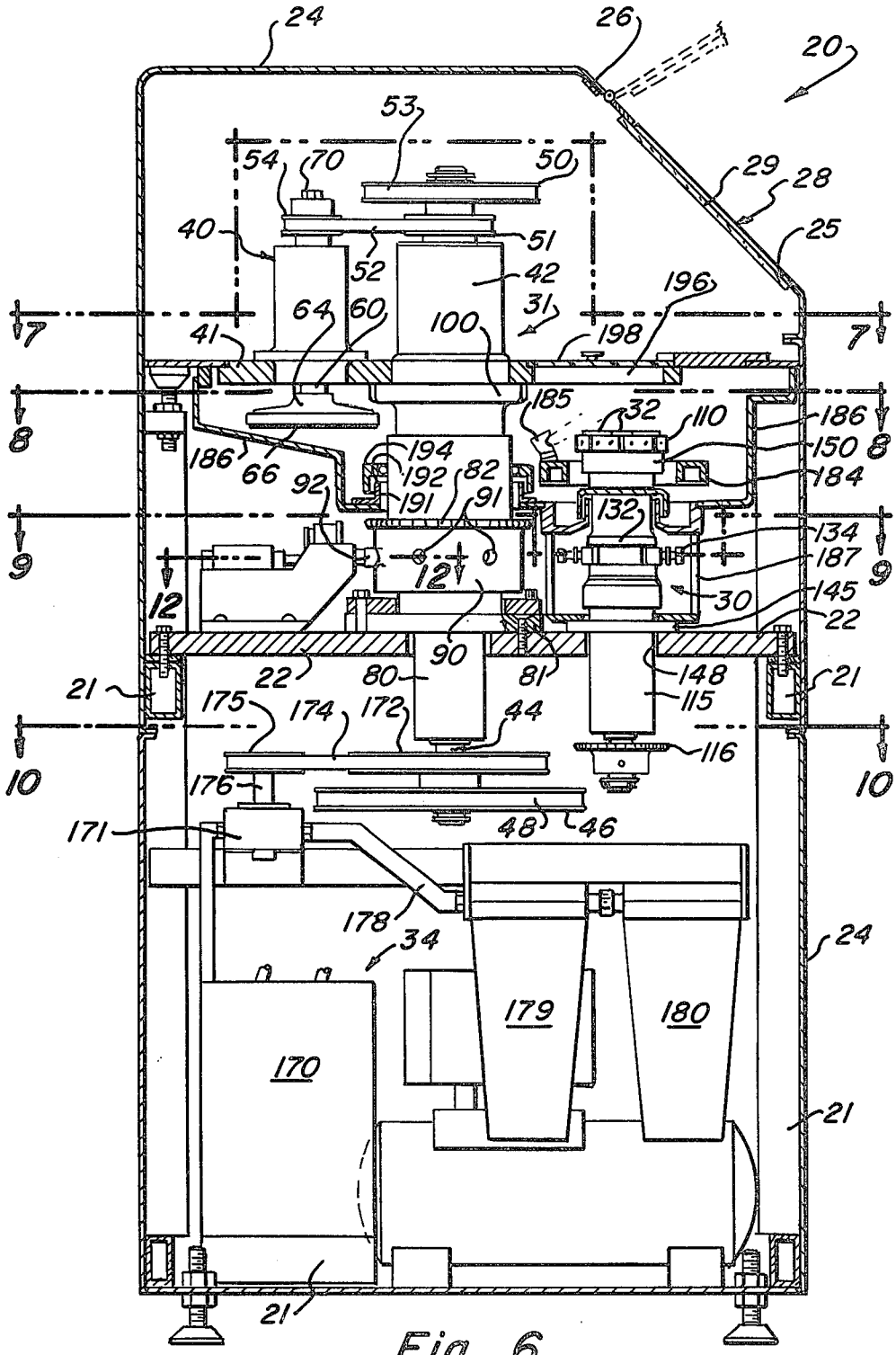
FIG. 6 is an enlarged vertical section view of a grinding apparatus embodying the present invention, taken substantially in the plane of line 6—6 on FIG. 1.
Figure 7:
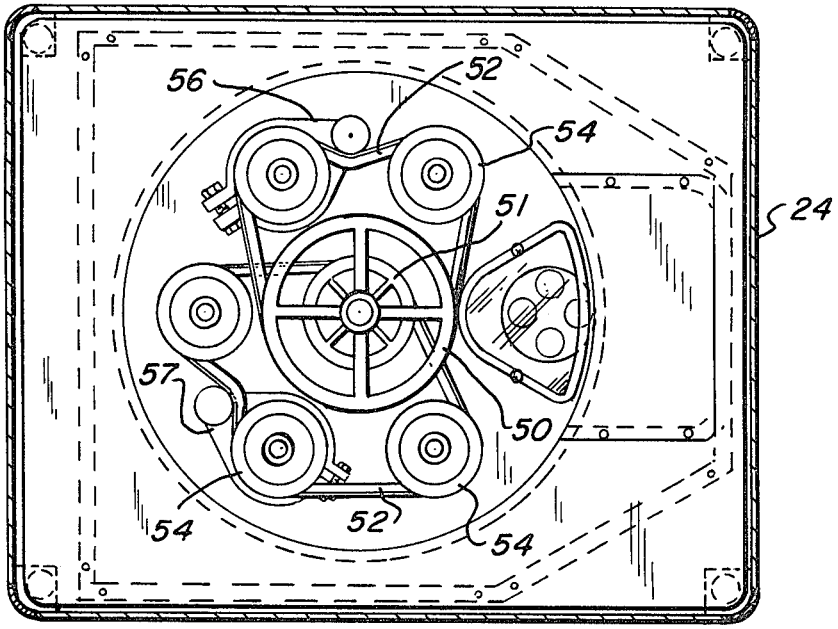
FIG. 7 is a horizontal section view taken substantially in the plane of line 7—7 on FIG. 6.
Figure 8:
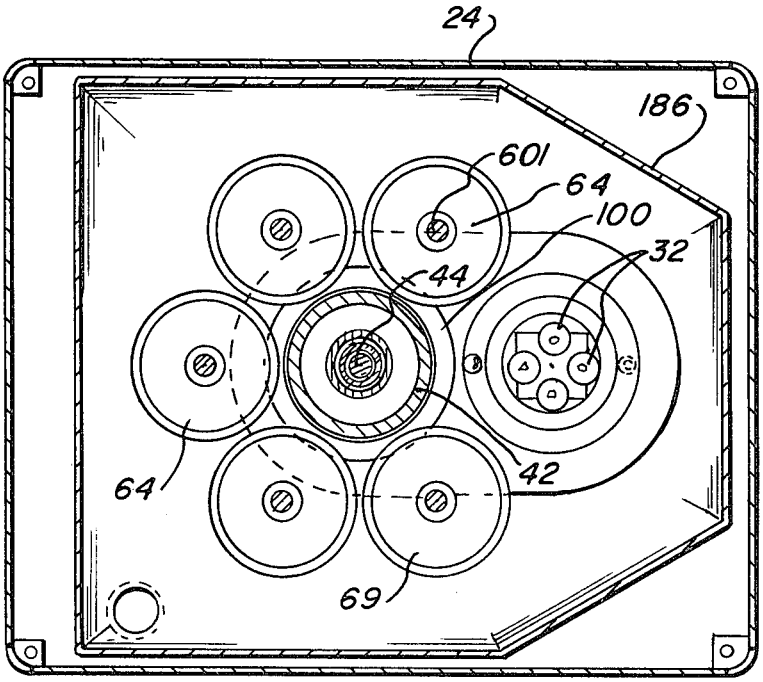
FIG. 8 is a horizontal section view taken substantially in the plane of line 8—8 on FIG. 6.
Figure 9:
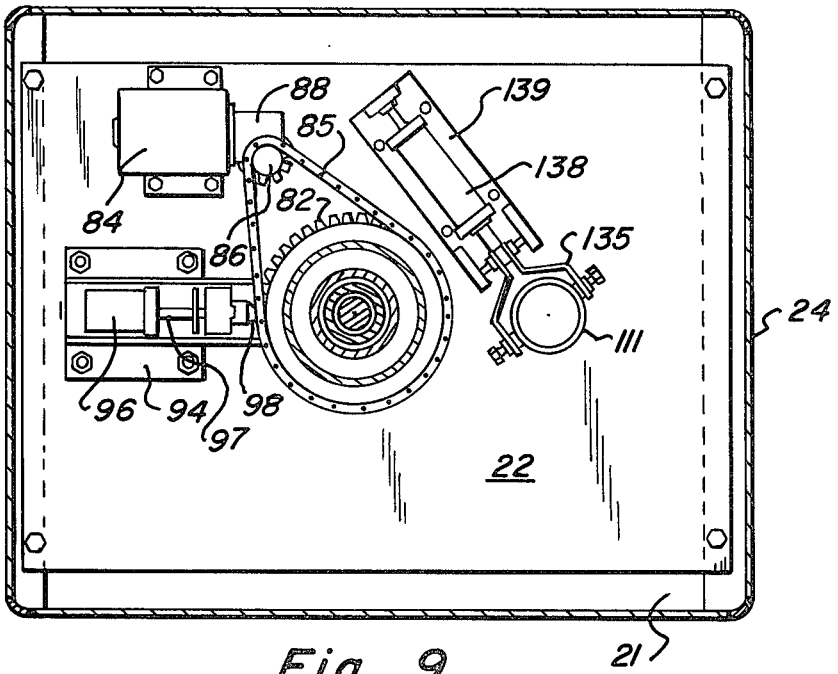
FIG. 9 is a section view taken substantially in the plane of line 9—9 on FIG. 6.
Figure 10:
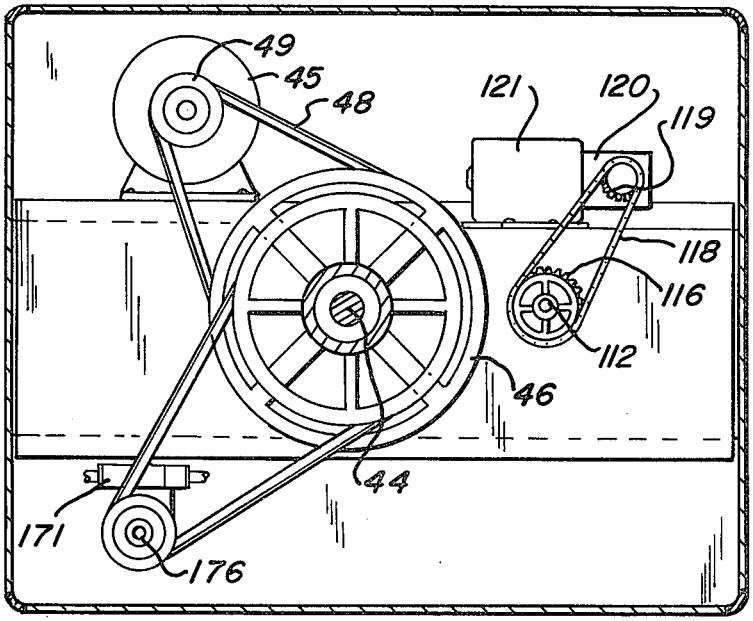
FIG. 10 is a horizontal section view taken substantially in the plane of line 10—10 on FIG. 6.
Figure 11:
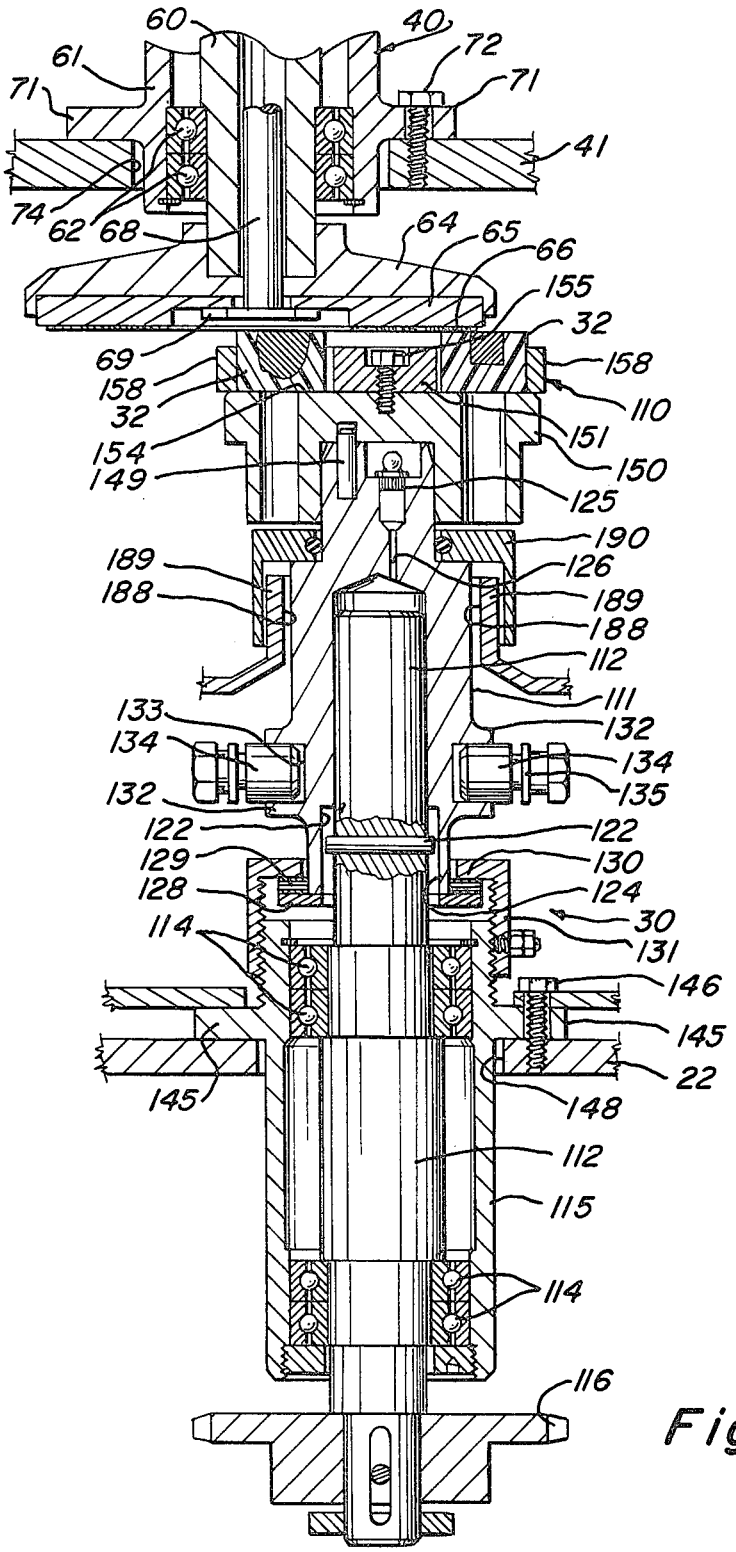
FIG. 11 is an enlarged section view taken substantially in the plane of line 11—11 on FIG. 6, but with a grinding assembly positioned in grinding relationship with a specimen chuck.
Figure 12:
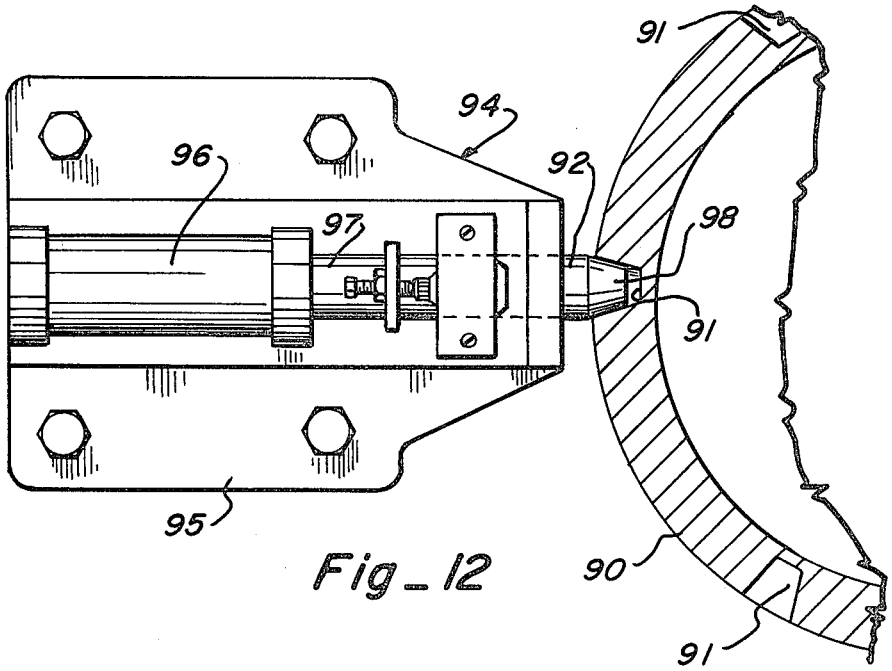
FIG. 12 is a section view taken substantially in the plane of line 12—12 on FIG. 6.
Figure 13:
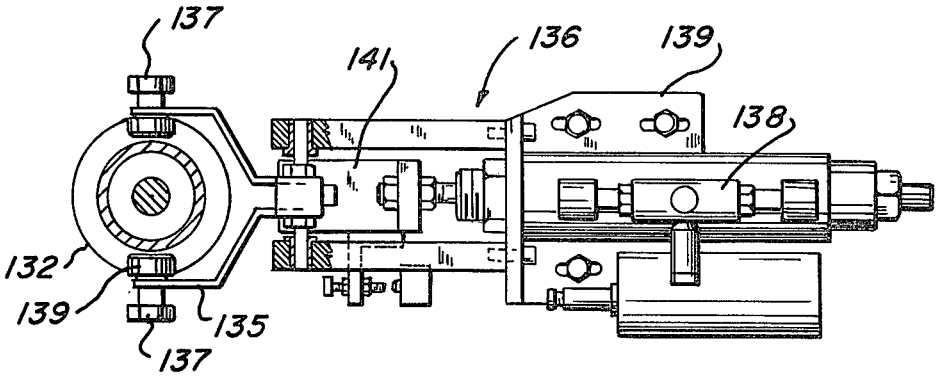
FIG. 13 is a detailed elevation view of the specimen chuck assembly lifting mechanism.
Figure 14:
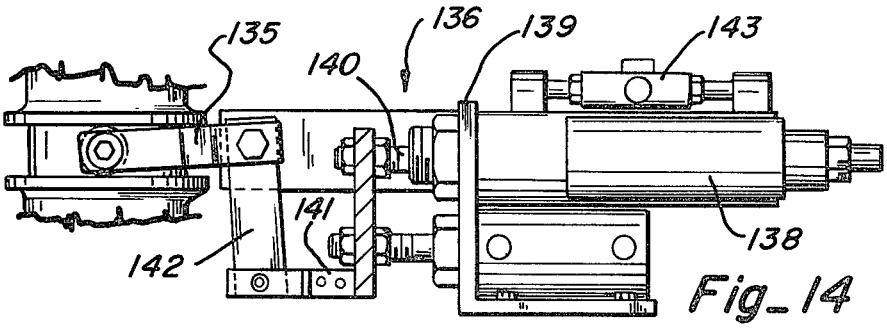
FIG. 14 is an elevation view of the specimen chuck lifting mechanism shown in FIG. 13.

In loading the specimens 32 to be ground into the chuck 110, it is important that the faces of the specimens to be ground are coplanar and that the plane of the specimen faces is parallel to the plane of the chuck face and hence the plane of the grinding laps, and at the required spacing above the chuck face. In order to insure this coplanar spaced relationship, a jig is provided, as shown in FIGS. 2 and 5, for use in mounting the specimens 32 in the chuck 150. This jig or level loader 200 comprises a base plate 201 and attached cover plate 202 between which is rotatably mounted a vernier plate 204. The vernier is supported between the base plate 201 and cover 202 by bearings 205. The vernier plate 204 is generally annular in configuration and defines a central threaded opening 206. Threadably engaged with the vernier is a vertically adjustable mounting plate 208 having a correspondingly threaded peripheral surface 209. The upper surface 210 of the plate defines a platform for supporting specimens to be loaded into a chuck supported on the upper peripheral surface of the vernier plate 204 in an access opening 211 defined in the upper plate 202. By threadably adjusting the vernier with respect to the main plate 208, the height of the specimens above the chuck face can be accurately located. To insure that the specimens are properly seated against the adjusting plate 208, a spring loader 212 is provided having depending tubular legs 214 slidably supporting telescoping pins 215 spring biased by coil springs 216 housed within the tubular legs. The legs and locating pins extend through corresponding apertures 218 in the chuck body with the pins 215 in seating engagement with the rear faces of the specimens 32. The springs are compressed to force the pins tightly against the specimens by a clamping screw 219 mounted in a cross-arm 220 supported on support posts 221. To mount the specimens in place, the specimens are placed loosely in the chuck which is then inverted onto the level loader. The spring holder is inserted in place and clamped with the knob 219. The weight of the chuck holds it against the upper surface of the vernier which can then be adjusted to accurately position the specimens. Once positioned, the chuck jaws are tightly clamped in place to secure the specimens tightly within the chuck.

To grind the specimens, a chuck with the specimens in place is inserted into the machine through the access openings and mounted on the specimen drive assembly spindle. The covers are closed and the machine activated to perform the desired selected cycle. Appropriate automatic controls including electronic circuits and a microprocessor are provided to select and control the machine cycle, grinding speeds and pressure of the specimens against the laps.

The rotational speeds of the various laps are predetermined and controlled. Likewise, the rotational speed of the specimen holder, the speed at which the specimen holder approaches each lap, the pressure between the specimens and the laps, and the amount of material removed by each lap, are be accurately controlled in accordance with a predetermined grinding program.

To illustrate a grinding program, specimens of hardened steel, for example, may be ground with the cycle conditions shown in Table I.

TABLE I

| | GRINDING STATION | | | | |
|---|---|---|---|---|---|
| | 1 | 2 | 3 | 4 | 5 |
| Lap rotation speed, rpm | 1200 | 1200 | 420 | 390 | 500 |
| Specimen holder rotation speed, rpm | 150 | 150 | 150 | 250 | 250 |
| Pressure between lap and specimen, lbs. | 40 | 40 | 35 | 30 | 30 |
| Time, min. | 1.5 | 1.0 | 1.0 | 2.0 | 2.0 |

The machine controls further permit the operation to shut off the cooling and grinding solution pump and the lap motors to allow for the change or removal of the laps. To this end, the machine may be manually indexed to position each lap selectively in access position.

While an illustrative embodiment of the present invention has been shown in the drawings and described above in considerable detail, it should be understood that there is no intention to limit the invention to the specific form disclosed. On the contrary, the intention is to cover all modifications, alternative constructions, equivalents and uses falling within the spirit and scope of the invention as expressed in the appended claims.

What I claim is:

1. A grinding machine for grinding and polishing metallographic specimens, comprising, in combination, a rigid frame and housing; a multiple-lap, indexable, vertical grinder assembly supported on said frame within said housing, means for rotating each lap of said assembly about a vertical axis, a rotating vertically positionable specimen holder assembly supported on said frame within said housing, and a coolant and grinding fluid system supported on said frame within said housing for supplying coolant and grinding fluid to specimens supported in said specimen holder during grinding thereof, means for indexing said grinder assembly for the relative positioning of laps with respect to said specimen holder, means for rotating said specimen holder about a vertical axis and means for vertically positioning said specimen holder relative to and with a predetermined pressure against a selected lap of said grinder assembly, whereby specimens held by said holder can be ground and polished to a predetermined finish by a selected successive plurality of laps.

2. A grinding machine for grinding and polishing metallographic specimens, comprising, in combination, a rigid frame and housing, a multiple-lap, indexable, vertical grinder assembly supported on said frame and including a plurality of laps, a first prime mover operatively connected in driving relation with said grinder assembly for rotating each of said laps thereof, a rotating vertically positionable specimen holder, a second prime mover operatively connected in rotary driving relation with said specimen holder, means for indexing said vertical grinder assembly for positioning said laps successively in grinding relationship with said specimen holder, means for raising and lowering said specimen holder relative to said grinder assembly and for holding said specimen holder at a predetermined pressure against a selected lap of said grinder assembly, and a coolant and grinding fluid system supported on said frame for supplying coolant and grinding fluid to said specimen supported in said specimen holder during grinding thereof, whereby specimens held by said holder can be ground and polished to a predetermined finish by a selected successive plurality of said laps.

3. A grinding machine for grinding and polishing metallographic specimens, comprising, in combination: a rigid frame; a multiple-lap, indexable, vertical grinder assembly supported on said frame; a first prime mover; means operatively coupling said laps to said first prime mover for rotating said laps at selected speeds; means for indexing said grinder assembly to position said laps in a preselected grinding position; a rotating vertically positionable specimen holder assembly; a second prime mover; means operatively coupling said second prime mover and said specimen holder for rotating said specimen holder at a selected speed relative to a juxtaposed lap; means for controllably raising and lowering said specimen holder relative to a juxtaposed lap and for holding a specimen carried by said holder at a predetermined pressure against said juxtaposed lap; and a coolant and grinding fluid system supported on said frame for supplying coolant and grinding fluid to specimens supported in said specimen holder and adjacent lap during the grinding of said specimens; whereby specimens held by said holder can be ground and polished to a predetermined finish by a selected successive plurality of laps.

4. A machine for grinding metallographic specimens, comprising, in combination, a rigid frame, a multiple-station, indexable, vertical grinder assembly supported on said frame and including a grinder lap at each station; means operatively connected in driving relation with said grinder assembly for rotating the lap at each station thereof, a rotating, vertically positionable specimen holder; means operatively connected in driving relation with said specimen holder for rotating said specimen holder; means for holding a specimen carried by said holder at a predetermined pressure against a selected lap, and a grinding fluid system supported on said frame for supplying grinding fluid to specimens supported in said specimen holder during grinding thereof, said grinder assembly being indexable for the relative positioning of grinder laps with respect to said specimen holder whereby specimens held by said holder can be ground sequentially at a selected plurality of grinder stations to a predetermined finish.

5. A grinding machine for grinding and polishing metallographic specimens, comprising, in combination, a rigid frame and housing; a multiple-lap, indexable, vertical grinder assembly supported on said frame; a rotating, vertically positionable, specimen holder assembly supported on said frame; and a grinding fluid system supported on said frame for supplying grinding fluid to specimens supported in said specimen holder during grinding thereof, said grinder assembly being indexable for the relative positioning of laps with respect to said specimen holder, and said specimen holder being vertically positionable relative to said laps for positioning a specimen at a predetermined pressure against a lap; whereby specimens held by said holder can be ground and polished to a predetermined finish by a successive plurality of laps.

6. A grinding machine for grinding and polishing metallographic specimens, comprising, in combination, a rigid frame and housing, a multiple-laps, indexable, vertical grinder assembly supported on said frame and including a plurality of laps, a first prime mover operatively connected in driving relation with said grinder assembly for rotating each of said laps thereof at a preselected speed, a rotating vertically positionable specimen holder, a second prime mover operatively connected in controlled rotary driving relation with said specimen holder, means for indexing said vertical grinder assembly for positioning laps successively in grinding relationship with said specimen holder, means for controllably raising and lowering said specimen holder relative to said grinder assembly and for holding said specimen holder with specimens against said laps under controlled pressure, and a coolant and grinding fluid system supported on said frame for supplying coolant and grinding fluid to said specimen supported in said specimen holder during grinding thereof, whereby specimens held by said holder can be selectively ground by a successive plurality of said laps.

7. A grinding machine for grinding and polishing metallographic specimens, comprising, in combination, a rigid frame and housing, a multiple-lap, indexable, vertical grinder assembly supported on said frame within said housing, a variable speed rotating, vertically positionable specimen holder assembly supported on said frame within said housing, and a coolant and grinding fluid system supported on said frame within said housing for supplying coolant and grinding fluid to specimens supported in said specimen holder during grinding thereof, means for indexing said grinder assembly for the relative positioning of laps with respect to said specimen holder relative to said grinder assembly and for holding said specimens against a lap with a predetermined controlled force, whereby specimens held by said holder can be ground and polished by a selected successive plurality of laps.

8. A grinding machine for grinding and polishing metallographic specimens, comprising, in combination: a rigid frame; a multiple-lap, indexable, vertical grinder assembly supported on said frame; a first prime mover; means operatively coupling said laps to said first prime mover for rotating said laps at selected speeds; means for indexing said grinder assembly to position said laps in a preselected grinding position; a rotating vertically positionable specimen holder assembly, a second prime mover; means operatively coupling said second prime mover and said specimen holder for rotating said specimen holder at a selected speed relative to a juxtaposed lap; means for controllably raising and lowering said specimen holder relative to a juxtaposed lap and for holding specimens against said lap with a predetermined controlled force; and a coolant and grinding fluid system supported on said frame for supplying coolant and grinding fluid to specimens supported in said specimen holder and adjacent lap during the grinding of said specimens; whereby specimens held by said holder can be ground and polished by a selected successive plurality of laps.

* * * * *